US007775046B2

(12) United States Patent
Ingham et al.

(10) Patent No.: US 7,775,046 B2
(45) Date of Patent: Aug. 17, 2010

(54) METHOD AND APPARATUS FOR AUGMENTED HEAT UP OF A UNIT

(75) Inventors: Bradley Cyril Ingham, Halifax (CA); Steven J. Barber, Louisville, KY (US)

(73) Assignee: BJ Services Company LLC, Houston, TX (US)

( * ) Notice: Subject to any disclaimer, the term of this patent is extended or adjusted under 35 U.S.C. 154(b) by 280 days.

(21) Appl. No.: 11/557,863

(22) Filed: Nov. 8, 2006

(65) Prior Publication Data

US 2007/0119176 A1 May 31, 2007

Related U.S. Application Data

(60) Provisional application No. 60/735,009, filed on Nov. 8, 2005.

(51) Int. Cl.
*F01K 13/02* (2006.01)

(52) U.S. Cl. ..... 60/646; 60/657

(58) Field of Classification Search ..... 60/643, 60/645, 646, 657
See application file for complete search history.

(56) References Cited

U.S. PATENT DOCUMENTS 2,869,323 A 1/1959 Nest
3,505,201 A * 4/1970 Kruyer et al. ..... 208/410
4,104,869 A 8/1978 Vincent
4,311,025 A * 1/1982 Rice ..... 62/502
4,393,653 A * 7/1983 Fischer ..... 60/511
4,880,458 A 11/1989 Martinez-Vera
4,893,467 A 1/1990 Woodson

FOREIGN PATENT DOCUMENTS

EP 0209820 A1 1/1987
EP 1001149 A2 5/2000
EP 1500792 A2 1/2005

OTHER PUBLICATIONS

European Search Report for Corresponding European Application No. EP 06 02 2768.
Written Opinion for Corresponding European Application No. EP 06 02 2768.
Office Action from related European Patent Application No. 06 022 768.3-2301 mailed Aug. 7, 2008.

* cited by examiner

*Primary Examiner*—Hoang M Nguyen
(74) *Attorney, Agent, or Firm*—Zarian Midgley & Johnson PLLC

(57) ABSTRACT

A system and a method of augmenting the heat up of a unit using a compressed, heated gas that contains moisture such as steam or vaporized water such that the specific heat of the gas is increased. In a preferred embodiment, steam in compressed inert gas such as nitrogen is capable of augmenting the heat up cycle for units such as process reactor vessels, furnaces, process steam and power production boilers, turbines, and other production vessels.

15 Claims, 1 Drawing Sheet

METHOD AND APPARATUS FOR AUGMENTED HEAT UP OF A UNIT

This application relies upon U.S. Provisional Application Ser. No. 60/735,009 filed Nov. 8, 2005.

FIELD OF THE INVENTION

The present invention and its method of use are applicable to units which benefit from being heated up before activation, namely those with high operational temperatures and large masses including but not limited to process reactor vessels, furnaces, process steam and power production boilers, turbines, and other production vessels.

BACKGROUND OF THE INVENTION

Massive units like process reactor vessels, furnaces, process steam and power production boilers, turbines, and other devices benefit from pre-heating to prevent damage by heating up too fast or other damage caused by low temperature startup. One example is a typical Fluidized Bed Catalytic Converter found in numerous refineries. These units can be heated up with steam, however at temperatures below 100° C. the steam can condense. The condensate can then be absorbed by the significant amounts of refractory. The steaming can heat up the unit very quickly, however if done too quickly the condensate absorbed into the refractory can flash off very quickly causing significant damage. Given the costs associated with downtime with systems like this, a need exists to quickly heat up these units in a controlled manner after maintenance cycles or other outages.

In the power industry, electricity is produced with a spinning turbine that is turned at high speeds to generate electricity. This turbine can be turned by water, by gas, or by high temperature steam. A steam turbine is driven by high temperature steam from a conventional boiler or nuclear reactor at speeds averaging 1800 to 3600 rpm. Many of the modern stream turbines operate at temperature in excess of 500° C.

Units such as these turbines experience substantial heat up problems associated with planned major outages, planned minor outages, and unplanned outages. After the mechanical repairs and replacement parts are installed on a cold turbine, the turbine needs to be readied for use. In most cases the only option to heat up the turbine is to introduce a full flow of steam into the turbine resulting in very aggressive heating which can damage the equipment. There are two primary issues on steam turbine heat ups. Various seals that control and direct the steam flow through the turbine do not properly seat and properly direct that flow until these metal seals are heated and expanded with temperature. Using uncontrollable low temperature steam that is saturated with moisture that is not following the designed flow paths due to the turbine seals not initially seating properly, causes damage in the form of erosion corrosion on turbine parts. Second issue, when these new parts are installed, the parts do not exactly fit the wear area of the old part that was replaced. As the cold turbine is placed on line, vibrations form that can be excessive with these new parts not seating properly. This requires shutting the unit back down and mechanically adjusting the new parts and rebalancing the machine and then trying to start the machine back up. Even and controlled heating of the turbine prior to startup, alleviates most of these vibration problems by preheating the new parts to expand and properly seat to a position intended by the turbine design, saving several days in the startup of a refurbished turbine. The operator of the machine should, over a period of several hours, carefully preheat (prewash) the turbine at a slow rate, prior to placing the turbine into production. Steam prewashing can only be controlled by the rate of the steam injection, since temperature control of the steam is not readily obtainable. This method gives a controlled rate of heating by using a nitrogen prewash at controlled temperatures and flows. Alternatives to this aggressive heating are to use a stable vapor to heat the turbine up in a controlled manner to a safe temperature before opening the steam control valves. It is envisioned that augmented heat up of a steam turbine may result in some start-up timesavings of about 4 to about 40 hours to heat up the system back to an operational level. This inefficiency represents a substantial amount of lost production and associated revenues for a given generating unit on an annual basis.

The prior art uses heated compressed gases such as compressed, heated air or nitrogen for a heating up large steam turbines at electrical generation stations. Moreover, when these gases are used to heat up the unit after maintenance the compression of the air or the nature of the inert gas used leaves the gas extremely dry. Nitrogen vapor typically has a dew point of −70° C. Compressed air is not as dry but typically comes out of a compressor at dew points of −10° C. or lower and is usually devoid of any water due to compression and the effect on the dew point. The lack of water in the heat up gas means that the specific heat of the heat up medium can be improved by the incorporation of a controlled amount of water vapor, which is fully absorbed into the heat up medium.

Therefore, a benefit exists to take advantage of the specific heat of water vapor into the heat up process of units that can benefit from controlled heating.

SUMMARY OF THE INVENTION

The present invention provides for a method of adding water vapor to gases used for heating purposes such that the specific heat of the heat up media is increased. By increasing the specific heat of the heat up flow a unit may be brought back to operation temperatures more quickly and economically than with traditional controlled heating practices after maintenance periods.

The present invention offers a system and method applicable to the controlled and augmented heat up of units, such as units that include static, rotating and moving equipment, but may be used in the effort to heat up any unit that will not react adversely with a gas, moistened but not saturated with water vapor. In a preferred embodiment, a measured quantity of saturated steam is mixed and absorbed into a compressed flow of hot nitrogen, which is then passed through the unit. The inclusion of steam or vaporized water will allow for the carrying of additional heat that will augment the rate of temperature increase in the unit. This heat up period can represent a substantial savings in costs associated with the downtime of a unit for maintenance or if the outage occurs.

For performing this method on units that can be adversely affected by condensate care is taken to ensure that the resulting gas has a dew point substantially lower than the lowest temperature in the unit being heated. This control involves knowledge of the gas being used, a precise determination of the steam injection rate, or direct measure of the resulting dew point of the injection gas, and a determination of the temperature of the unit being heated. Generally it is expected that the dew point can be no higher than 25° C. less than the temperature of vapor discharge from the unit.

Nitrogen is pumped as a gas into the unit in a controlled manner and steam or water is added and allowed to mix with the nitrogen or similar gas flow. This method increases the heat capacity of the heating media and accelerates the heating process in a controlled manner preventing thermal stresses and cracking of the internal components of the unit. For example, if the unit is a steam turbine, the turbines metals are not inundated with uncontrolled heating such that internal components such as to cause warping, humping, or uneven heating across the moving parts that will come into contact with non-moving parts. In the case of a high-pressure steam turbine, the outer seals do not seat until those seals are heated above 100° C. Controlled heating of these seals assures move even flow of heating gases into the turbine for a safer start up of the machine. In example of units without moving parts, this technique is equally applicable.

The present invention also allows for faster heat up after shut down for cleaning. For example, units such as a steam turbine have metal temperatures that may need to be brought below 80° C. The present invention will allow for this unit and other types of units be brought up the operational temperature profile of about 260-540° C. or higher at a faster, but controlled rate.

In a preferred embodiment, the present invention provides a flow of gas, such as a compressed flow of nitrogen from a nitrogen pumper. The gas flow is heated in excess of 100° C. In one embodiment, saturated steam is injected or otherwise introduced into the flow of heated gas. The flow of gas containing the saturated steam is preferably passed through a water trap capable of trapping or otherwise capturing any condensate or water. This allows for the steam augmented gas flow to enter the unit with a greater heat capacity. In an alternative embodiment, a flow of water is injected or otherwise interspersed into the flow of gas. The heated gas and water are heated as necessary to vaporize the water and create an augmented flow of gas in a gas heater prior to entry into the unit.

The present invention may also take advantage of the many different types of instrumentation that already exist on the turbine to monitor temperature, vibration, and growth or shrinkage of the machine as it operated. As the augmented gas is introduced into various ports or connections on the unit, these instruments are monitored across the machine to monitor how the machine is reacting to the rate that the augmented gas is being introduced. The ports or connections used on the turbine for augmented gas injection will depend on the various designs that exist.

Therefore the different methods discussed herein provide options for applying the augmented gas without damaging the internal components of the unit by uneven heating or overspinning of moving components, if present. With the augmented gas flow control station, augmented gas can be introduced to different areas of the unit at different temperatures and/or different flow rates and heating can be accomplished at different rates in different areas of the unit so that the machine is heated up evenly without damage. The present invention is described in conjunction with one embodiment of the invention, but those skilled in the art recognize that the teachings herein are equally applicable to different embodiments with varying connections.

BRIEF DESCRIPTION OF THE DRAWINGS

The accompanying drawings, which are incorporated in and form a part of the specification, illustrate the embodiments of the present invention, and, together with the description, serve to explain the principles of the invention. In the drawings.

It is to be noted that the drawings illustrate only typical embodiments of the invention and are therefore not to be considered limiting of its scope, for the invention encompasses other equally effective embodiments.

DETAILED DESCRIPTION OF PREFERRED EMBODIMENT

As understood herein, units that are considered to be within the scope of the invention include any system through which gas can be passed for the purposes of heating. This includes, but is not limited to various designed industry vessels, reactors including process reactor vessels, furnaces, process steam and power production boilers, turbines including gas and steam turbines, and other production vessels. In a preferred embodiment, the present invention may be used on units that operate over 100° C. Those skilled in the art will recognize that the inventive concepts as disclosed and claimed herein are equally applicable to units operating at any temperature that benefit from controlled heating. The present invention will be described in light of a steam turbine, but those skilled in the art will recognize the benefit of augmenting the heat up process in any type of unit that is not adversely affected by the introduction of unsaturated vapor.

It is not envisioned that this system and method of augmented heat up would be appropriate for units that cannot interact with steam. An example is a firebrick oven that will dust or otherwise be damaged by the introduction of steam in the augmented flow of gas.

The present invention offers augmented heat up of a unit in order to reach operational temperatures. It is envisioned that this method of augmented heat up may occur after maintenance or similar activity. Though the present invention will be described in detail with respect to the use of a flow of nitrogen, those skilled in the art will recognize that any gas may be used in the heat up process as long as the introduction of the gas will not damage or adversely affect the unit to be heated. It is envisioned that the use of an inert gas such as nitrogen is preferable in many instances.

It is envisioned that augmented heat up of a steam turbine may result in some start-up time savings of about 25-40% over pure vapor heating processes, depending on the unit considered and the type of power plant start-up performed. The ability to put units such as steam turbines back in operation more quickly can result in a significant capacity increase.

Figure 1:
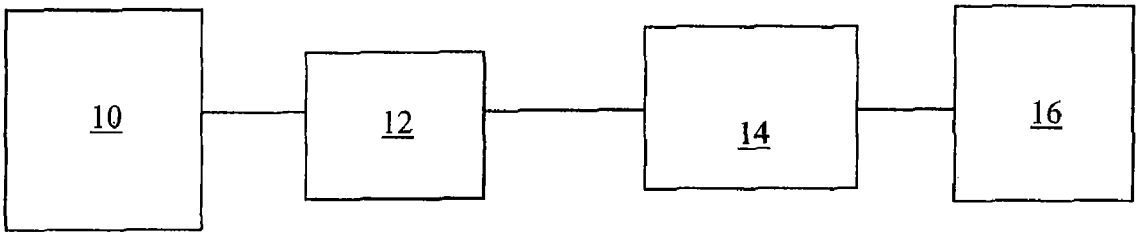
FIG. 1 shows a preferred implementation of the augmented heat up of a unit using steam.

FIG. 1 shows a preferred method of interjecting steam in a compressed flow of nitrogen. Nitrogen is typically transported to sight as a cryogenic gas that typically has a dew point of −70° C. As the gas passes from a nitrogen pump 10, it is typically heated to at least a temperature 30° C. The dew point is raised such that a significant amount of water such as saturated steam can be interspersed in the flow of nitrogen. In FIG. 1, saturated steam is introduced at injection point 12. The augmented flow of gas is then passed through a water trap 14 that captures any condensation from entering the unit 16.

Figure 2:
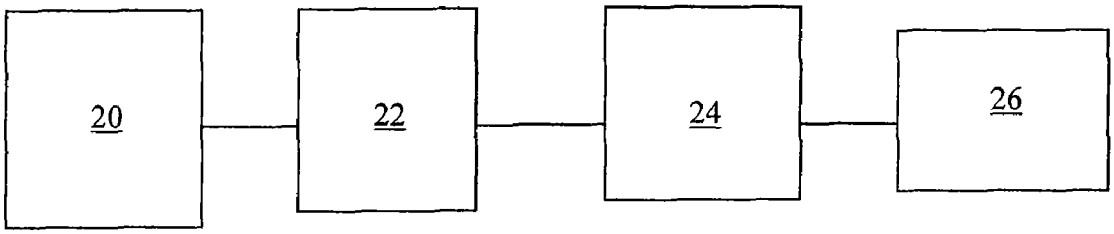
FIG. 2 shows a preferred implementation of the augmented heat up of a unit using vaporized water.

In an alternative embodiment shown in FIG. 2, the nitrogen pump 20 compresses a flow of nitrogen that passes through a water injector 22. The combination of compressed gas and injected water passes into a vaporization chamber or gas heater 24 that vaporizes the water injected in the water injector 22. The vaporized, heat up flow passes into the unit 26 from the chamber 24.

Figure 3:
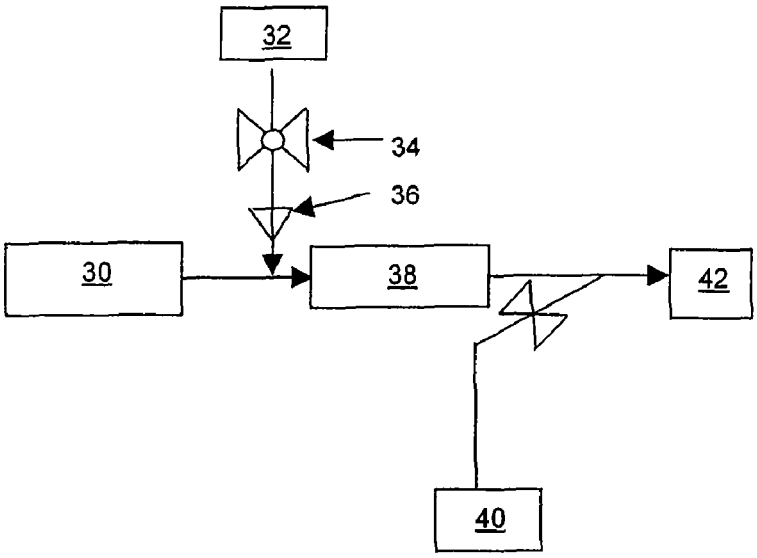
FIG. 3 shows a preferred implementation of the augmented heat up of a unit using vaporized water.

As shown in FIG. 3, a nitrogen pump or air compression and heating spread 30 provides nitrogen or air at low dew point. By increasing the dew point of a gas, it is possible to significantly increase the specific heat of the gas and to deliver more heat to a system. Careful injection, mixing and monitoring allow the dew point to be kept safely below the temperature of the system being heated without running the risk of creating condensate. In a preferred embodiment, the vapor may be in excess of 150° C. Steam 32 is provided via a control valve 34 and a check valve 36 and the combination passes through a static mixer 38. The steam can be saturated, but is preferably at a pressure greater than the nitrogen line. The static mixer 38 is used to mix the water vapor with the dry gas 30 to accelerate absorption. An optional dew point sampler 40 is used to determine effective dew point of vapor. Dew point is preferably held to about 50° C. below minimum expected vessel temperature so as not to condense liquid from within unit being heated. The mixed stream then may pass onto the system 42.

In an air process water or moisture is squeezed from the gas, and removed during any compression process. This results in dry air for which these embodiments also apply.

The specific heat (h) of the flow of either air or nitrogen vapor with water content (g) can be represented by the following formula:

$$h=(1.007t-0.026)+g(2501+1.84t) \quad \text{(i)}$$

wherein:

t=temp ° C.

g=Kg water/kg gas

The water content at dew point

=−60° C. g≈0.0001 kg/kg and

=+30° C. g≈0.02071 kg/kg therefore:

h(t=40° C., DP=~−60° C.)≈40.51 kj/kg and h(t=40° C., DP=~−30° C.)≈93.57 kj/kg

Accordingly, the use of the present invention provides an augmented heat up flow with a specific heat that is more than double. By increasing the specific heat, more heat can be provided to the unit 16, 26 and the heat up period can be shortened extensively.

The present invention is applicable to any temperature range, provided that the minimum temp in the flow entering into the unit 16, 26 is greater than the final dew point by 25° C. to avoid condensation inside the unit 16, 26.

It is envisioned that this injection of augmented heat up may occur at least one location on the unit 16, 26. The location of injection or introduction of the flow of nitrogen can be important to provide the needed heat up in an even and controlled manner. Factors including the size of existing piping or connections, the length of piping runs, the location on the turbine, the ease of connection, the proximity to the nitrogen pump truck, and the unit temperature should be considered.

The location of the nitrogen discharge is also important. Factors to consider include confined space safety, oxygen depravation, transport to atmosphere, and existing steam turbine and power plant piping. In general, it is preferable to accommodate the location of existing piping and connections and the location for discharge to atmosphere.

Turning to the confined space and oxygen depravation considerations, the use of large volumes of nitrogen or other gas in a area containing the unit may require special consideration of confined space requirements for a given power plant and utility. It is important to vent the nitrogen or other gas in a manner that will not create an oxygen depravation issue in a confined space.

The heat up rate of the unit is primarily influenced by the amount of flow of the gas and the amount of steam through the unit given that the heat capacity and temperature differential will be affected by a given design and operating condition of the unit.

It is envisioned that this system and method of augmented heat up may be monitored and/or controlled by a controller that includes a computer data acquisition and control system to coordinate the gas admission valves with the introduction of steam and/or water. This controller may also monitor or control the unit and any components of the unit, such as turbine speed, turbine shell temperatures, turbine rotor temperatures, first stage metal temperature, axial shell to rotor clearance, rotor long/rotor short, and other aspects needed to be monitored or controlled.

Having described the invention above, various modifications of the techniques, procedures, material and equipment will be apparent to those in the art. It is intended that all such variations within the scope and spirit of the appended claims be embraced thereby.

What is claimed is:

1. A system for the augmented heat up of a unit comprising:

a gas pump for providing a heated, compressed flow of an inert gas;

a steam injector connected to the gas pump, wherein the injector is capable of injecting steam into the heated, compressed flow of inert gas;

a water trap connected to the injector and connected to the unit, wherein the water trap is capable of capturing condensation from the heated, compressed flow of inert gas containing the steam;

a static mixer connected to the gas pump and the steam injector; and a dew point sampler connected between the static mixer and the unit.

2. The system of claim 1 wherein the steam is saturated steam.

3. The system of claim 1 wherein the heated, compressed flow of the inert gas is greater than about 100° C.

4. The system of claim 1 further comprising a controller capable of monitoring the temperature of the unit.

5. The system of claim 1 wherein the inert gas is nitrogen.

6. The system of claim 1 wherein the unit is a turbine.

7. A method of augmenting the heat up of a unit comprising the steps of:

(a) pumping a heated, compressed flow of an inert gas;

(b) injecting steam into the heated, compressed flow of inert gas;

(c) mixing the inert gas and steam with a static mixer;

(d) monitoring the dew point of the mixture of inert gas and steam with a dew point sampler; and (e) augmenting the heat up of the unit with the heated, compressed flow of inert gas containing the steam.

8. The method of claim 7 wherein the method further comprises the step of trapping condensation prior to Step (e).

9. The method of claim 7 wherein the method further comprises the step of vaporizing the water prior to Step (c).

10. The method of claim 7 wherein the heated, compressed flow of inert gas is greater than 100° C.

11. The method of claim 7 further comprising a controller capable of monitoring the temperature of the unit.

12. The method of claim 7 wherein the inert gas is nitrogen.

13. The method of claim 7 wherein the unit is a turbine.

14. The system of claim 1 wherein the unit is a steam turbine.

15. The system of claim 1 wherein the water trap is disposed between the steam injector and the unit prior to the heated, compressed flow of inert gas entering the unit.

* * * * *